US009754713B2

(12) United States Patent
Wu et al.

(10) Patent No.: US 9,754,713 B2
(45) **Date of Patent: *Sep. 5, 2017**

(54) CHOKE

(71) Applicant: CYNTEC CO., LTD., Hsinchu (TW)

(72) Inventors: Tsung-Chan Wu, Hsinchu County (TW); Roger Hsieh, Hsinchu County (TW); Yi-Min Huang, Hsinchu (TW); Lan-Chin Hsieh, Kaohsiung (TW); Yu-Ching Kuo, Miaoli County (TW); Chia-Hui Lai, Chiayi County (TW)

(73) Assignee: CYNTEC CO., LTD., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/793,752

(22) Filed: Jul. 8, 2015

(65) Prior Publication Data

US 2015/0310975 A1 Oct. 29, 2015

Related U.S. Application Data

(63) Continuation of application No. 13/959,441, filed on Aug. 5, 2013, now Pat. No. 9,117,580, which is a (Continued)

(30) Foreign Application Priority Data

Feb. 27, 2009 (TW) ..... 98106464 A

(51) Int. Cl.
*H01F 27/02* (2006.01)
*H01F 27/06* (2006.01)
(Continued)

(52) U.S. Cl.
CPC ..... *H01F 27/022* (2013.01); *H01F 3/08* (2013.01); *H01F 17/045* (2013.01);
(Continued)

(58) Field of Classification Search
CPC ..... H01F 5/00; H01F 27/28
(Continued)

(56) References Cited

U.S. PATENT DOCUMENTS 4,760,366 A * 7/1988 Mitsui ..... H01F 27/255 336/198
6,198,373 B1 * 3/2001 Ogawa ..... H01F 17/0033 336/83

(Continued)

*Primary Examiner* — Tsz Chan
(74) *Attorney, Agent, or Firm* — Min-Lee Teng; Litron Patent & Trademark Office

(57) ABSTRACT

A choke includes a single-piece core made of a same material, the single-piece core having a first board, a second board, and a pillar located between the first and second boards, a winding space located among the first board, the second board and the pillar, wherein the pillar has a non-circular and non-rectangular cross section having a first axis and a second axis substantially perpendicularly intersecting with each other at a center of the cross section of the pillar, and wherein a circumference of the cross section of the pillar includes two arc edges, four first substantially straight edges substantially parallel to the first axis, and two second substantially straight edges substantially parallel to the second axis, each of the first substantially straight edges being a joint of and in direct contact with one of the arc edges and one of the second substantially straight edges.

19 Claims, 7 Drawing Sheets

Related U.S. Application Data continuation-in-part of application No. 13/331,786, filed on Dec. 20, 2011, now Pat. No. 9,208,937, which is a continuation-in-part of application No. 12/709,912, filed on Feb. 22, 2010, now Pat. No. 8,212,641.

(51) Int. Cl.

| | |
|---|---|
| ***H01F 27/29*** | (2006.01) |
| ***H01F 5/00*** | (2006.01) |
| ***H01F 27/28*** | (2006.01) |
| ***H01F 3/08*** | (2006.01) |
| ***H01F 17/04*** | (2006.01) |
| ***H01F 27/255*** | (2006.01) |

(52) U.S. Cl.
CPC ..... *H01F 27/255* (2013.01); *H01F 27/2823* (2013.01); *H01F 2017/048* (2013.01)

(58) Field of Classification Search
USPC ..... 336/65, 83, 192, 200, 232
See application file for complete search history.

(56) References Cited

U.S. PATENT DOCUMENTS

| | | | | |
|---|---|---|---|---|
| 6,696,913 | B2 * | 2/2004 | Meuche | H01F 3/08 336/208 |
| 7,209,022 | B2 * | 4/2007 | Kuroiwa | H01F 17/045 336/200 |
| 7,233,225 | B2 * | 6/2007 | Sato | H01F 27/255 336/200 |
| 2002/0190832 | A1 * | 12/2002 | Amada | H01F 17/045 336/192 |
| 2003/0071704 | A1 * | 4/2003 | Toi | H01F 17/045 336/83 |
| 2006/0244561 | A1 * | 11/2006 | Iwakura | H01F 27/325 336/212 |
| 2008/0055035 | A1 * | 3/2008 | Gerhard | H01F 17/062 336/84 C |
| 2011/0267167 | A1 * | 11/2011 | Ogawa | H01F 41/098 336/221 |

* cited by examiner

CHOKE

CROSS-REFERENCE TO RELATED APPLICATIONS

This application is a Continuation of application Ser. No. 13/959,441 filed on Aug. 5, 2013, which is a Continuation-in-part application of application Ser. No. 13/331,786 filed on Dec. 20, 2011, which is a Continuation-in-part application of application Ser. No. 12/709,912 filed on Feb. 22, 2010 (now U.S. Pat. No. 8,212,641 issued on Jul. 3, 2012). application Ser. No. 12/709,912 claims priority to Application No. 98106464 filed in Taiwan on Feb. 27, 2009 under 35 U.S.C. §119(a). The entire contents of all are hereby incorporated by reference.

BACKGROUND OF THE INVENTION

1. Field of the Invention

The present invention relates to a choke and, more particularly, to a choke capable of enhancing saturation characteristic.

2. Background of the Invention

A choke is used for stabilizing a circuit current to achieve a noise filtering effect, which is similar to what a capacitor achieves. For a capacitor, stabilization of the current is adjusted by storing and releasing electrical energy of the circuit. Compared to the capacitor that stores the electrical energy by an electrical field (electric charge), the choke stores the same by a magnetic field.

In the past, the chokes are generally applied in electronic devices such as DC/DC converters and battery chargers, and applied in transmission devices such as modems, asymmetric digital subscriber lines (ADSL), local area networks (LAN), etc. The chokes have also been widely applied to information technology products such as laptop computers, mobile phones, LCD displays, digital cameras, etc. Because of the trend of minimizing the size and weight of the information technology products, the height and size of the choke will be one of the major concerns when designing the choke.

As shown in FIG. 1, the choke 1 disclosed in U.S. Pat. No. 7,209,022 includes a drum-core 10, a wire 12, an exterior resin 14, and a pair of external electrodes 16.

Furthermore, as shown in FIG. 2, the cross section of the pillar 100 of the drum-core 10 is circular. In general, the larger an area of the cross section of the pillar 100 is, the better the characteristics of the choke 1 are. However, since the shape of the cross section of the pillar 100 is circular and the winding space S has to be reserved for winding the wire 12, the area of the cross section of the pillar 100 is limited, so that saturation current cannot be raised effectively.

There is another drum-core with a rectangular pillar disclosed in U.S. Pat. No. 7,495,538 (hereinafter the '538 Patent). In the '538 Patent, since the shape of the cross section of the pillar is rectangular, the wire may be damaged at the sharp corners of the pillar, and the characteristics of the choke (e.g., saturation current, direct current resistance, magnetic flux density, etc.) are worse.

SUMMARY OF THE INVENTION

Accordingly, it is an object of the present invention to provide a choke capable of enhancing saturation characteristic.

To achieve the above-mentioned object, according to a first aspect of the present invention, a choke comprises a single-piece core made of a same material, the single-piece core having a first board, a second board, and a pillar located between the first and second boards, a winding space being located among the first board, the second board and the pillar, wherein the pillar has a non-circular and non-rectangular cross section along a direction substantially perpendicular to an axial direction of the pillar, the cross section of the pillar has a first axis and a second axis intersecting with each other at a center of the cross section of the pillar and being substantially perpendicular with each other, and wherein a circumference of the cross section of the pillar includes two arc edges, four first substantially straight edges substantially parallel to the first axis, and two second substantially straight edges substantially parallel to the second axis, each of the first substantially straight edges being a joint of and in direct contact with a corresponding one of the arc edges and a corresponding one of the second substantially straight edges.

According to a second aspect of the present invention, a choke comprises a single-piece core made of a same material, the single-piece core having a first board, a second board, and a pillar located between the first and second boards, a winding space being located among the first board, the second board and the pillar, a permeability of the core being between 25 and 60; a wire wound around the pillar and located in the winding space; and a magnetic material filled in the winding space and encapsulating the wire, a permeability of the magnetic material being between 4 and 21.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
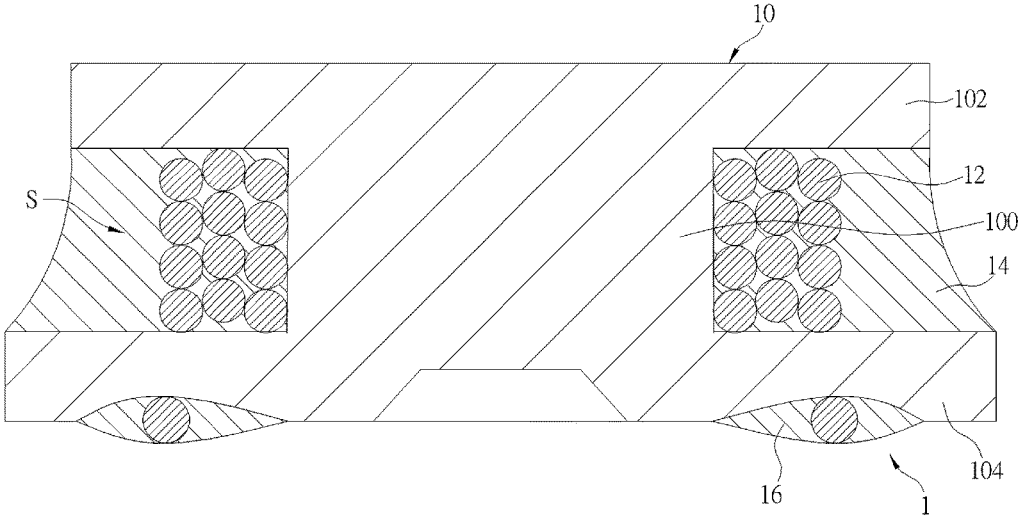
FIG. 1 PRIOR ART
FIG. 1 is a cross-sectional view of a conventional choke.
Figure 2:
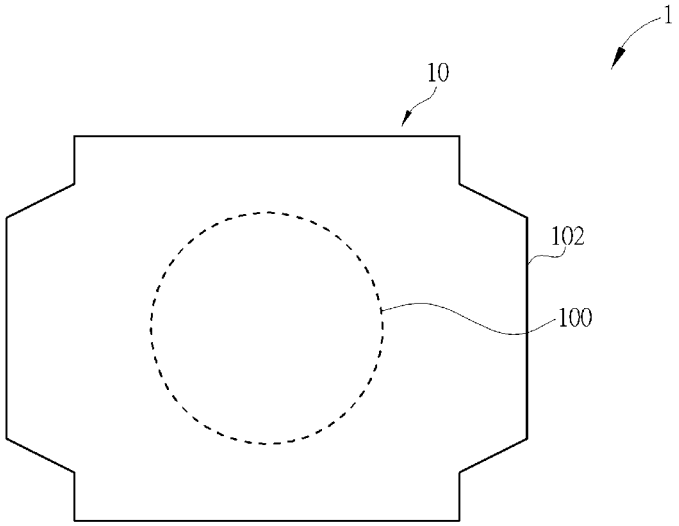
FIG. 2 is a top view of the conventional choke as shown in FIG. 1.

The present invention will now be described in detail with reference to the accompanying drawings, wherein the same reference numerals will be used to identify the same or similar elements throughout the several views. It should be noted that the drawings should be viewed in the direction of orientation of the reference numerals.

Figure 3:
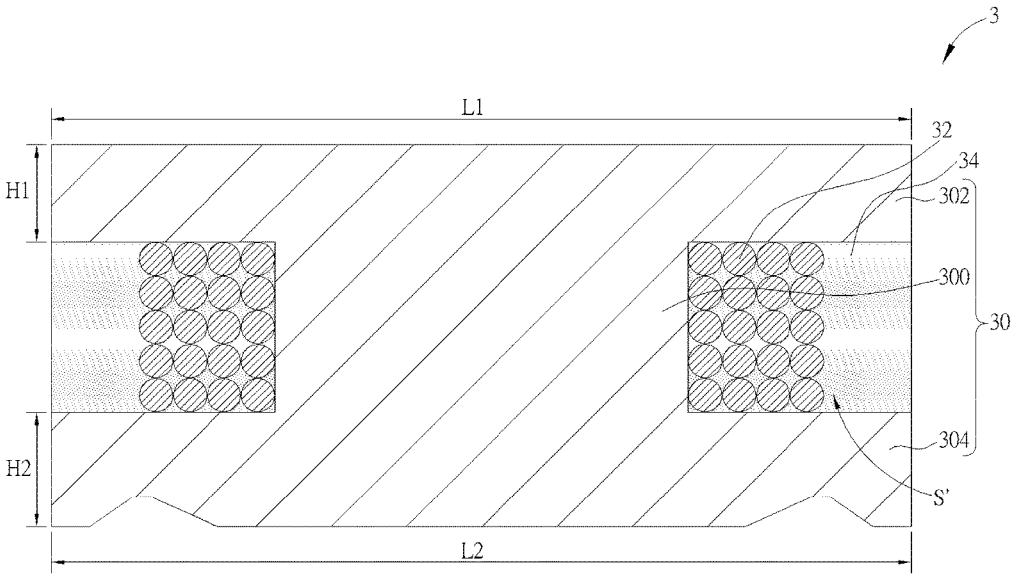
FIG. 3 is a cross-sectional view of a choke according to an embodiment of the present invention.
Figure 4:
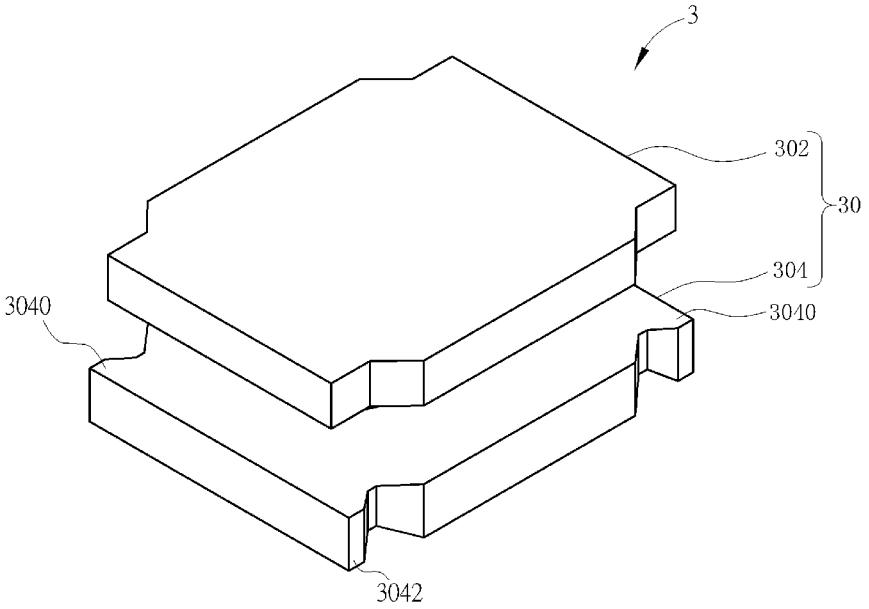
FIG. 4 is a perspective view of a core adapted for the choke as shown in FIG. 3.
Figure 5:
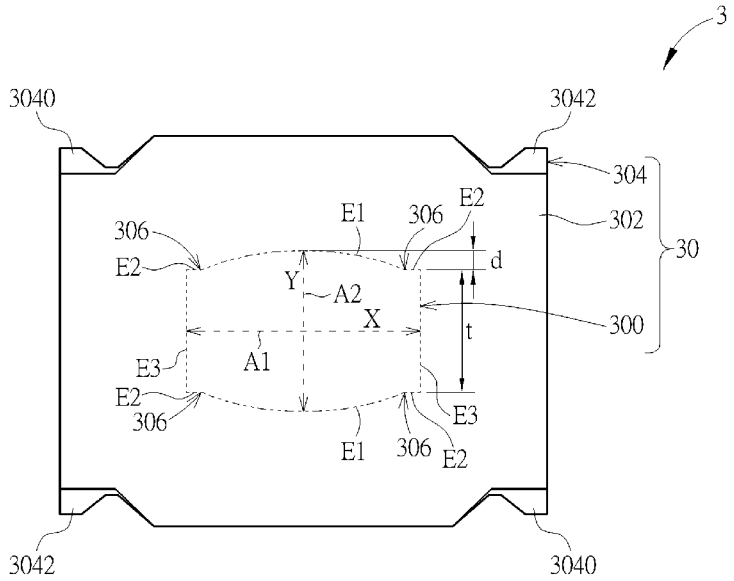
FIG. 5 is a top view of the core as shown in FIG. 4.

FIG. 3 is a cross-sectional view of a choke 3 according to an embodiment of the present invention, FIG. 4 is a perspective view of a core 30 adapted for the choke 3 as shown in FIG. 3, and FIG. 5 is a top view of the core 30 as shown in FIG. 4. As shown in FIGS. 3-5, the choke 3 includes a core 30, at least a wire 32 (only one is illustrated in FIG. 3), and a magnetic material 34. The choke 3 is suitable for a small size application. For example, the length*width of the chock 3 is below 4 mm*4 mm, and the height thereof is below 2.5 mm.

In an embodiment, the core 30 includes a pillar 300, a first boards 302 and a second board 304. The pillar 300 is located between the first and second boards 302, 304 and integrally molded with the first and second boards 302, 304. In an embodiment of the present invention, the core 30 is a single-piece structure entirely made of the same material. In other words, the combination of the pillar 300, the first board 302 and the second board 304 is a unitary, integral structure, and there is no gap or intervening material/structure at the entire junction between the pillar 300 and each of the first and second boards 302, 304. In addition, the pillar 300, the first board 302 and the second board 304 are entirely made of the same material. In an embodiment, the pillar 300, the first board 302 and the second board 304 may be made of same magnetic material(s), such as a mixture of a metallic powder and a binder, and the metallic powder in the core 30 is larger than 90 wt %, and an average particle diameter of the metallic powder is between 10 μm and 12 μm. For example, the metallic powder may be Fe—Cr—Si alloy, Fe—Al—Cr alloy, Fe—Si—Al alloy, Fe—Ni alloy, amorphous, nano-crystal, and so on. The binder may be inorganic binder (e.g., glass binder) capable of resisting high temperature around 400° C. to 700° C.

As shown in FIG. 5, a first axis A1 and a second axis A2 are intersecting with each other at a center C of the cross section of the pillar 300. The cross section of the pillar 300 is along a direction substantially perpendicular to an axial direction of the pillar 300. The first axis A1 is substantially (i.e., within the range of typical manufacturing deviation) perpendicular to and longer than or substantially (i.e., within the range of typical manufacturing deviation) equal to the second axis A2. A circumference of the cross section of the pillar 300 includes two arc edges E1, four first substantially (i.e., within the range of typical manufacturing deviation) straight edges E2 substantially (i.e., within the range of typical manufacturing deviation) parallel to the first axis A1, and two second substantially (i.e., within the range of typical manufacturing deviation) straight edges E3 substantially (i.e., within the range of typical manufacturing deviation) parallel to the second axis A2. In the illustrated embodiment as shown in FIG. 5, two upper substantially straight edges E2 are substantially (i.e., within the range of typical manufacturing deviation) aligned with each other along a direction parallel to the first axis A1, and two lower substantially straight edges E2 are substantially (i.e., within the range of typical manufacturing deviation) aligned with each other along a direction parallel to the first axis A1. Each of the first substantially straight edges E2 connects (i.e., is a joint of and in direct contact with) a corresponding one of the arc edges E1 and a corresponding one of the second substantially straight edges E3, each of the arc edges E1 is jointed to a corresponding one of the first substantially straight edges E2 at a joint/junction 306, and the second substantially straight edge E3 is shorter than the length of the cross section of the pillar 300 along the second axis A2. The cross section of the pillar 300 is substantially (i.e., within the range of typical manufacturing deviation) symmetrical to both of the first axis A1 and the second axis A2. In the illustrated embodiment as shown in FIG. 5, the two upper/lower substantially straight edges E2 are substantially symmetrical to each other with respect to the second axis A2, the two left/right straight edges E2 are substantially symmetrical to each other with respect to the first axis A1, and the two second substantially straight edges E3 are substantially symmetrical to each other with respect to the second axis A2, each of the second substantially straight edges E3 is substantially symmetrical with respect to the first axis A1, the two arc edges E1 are substantially symmetrical to each other with respect to the first axis A1, and each of the two arc edges E1 is substantially symmetrical with respect to the second axis A2. In this embodiment, the arc edges E1 may be formed as oval-arc shape so that a periphery/circumference of the cross section of the pillar 300 is non-circular and non-rectangular (such as an oval-like shape). In addition, the angle at joint/junction 306 of the arc edge E1 and the corresponding first substantially straight edge E2 is larger than 90°. In an embodiment, the end portion of the arc edge E1 that is in direct contact with the corresponding first substantially straight edge E2 can have a convex shape. In another embodiment, the end portion of the arc edge E1 that is in direct contact with the corresponding first substantially straight edge E2 can have a concave shape (compared to the main portion of the arc edge E1 that has a convex shape), such that a smooth transition from the concave end portion of the arc edge E1 to the corresponding first substantially straight edge E2 can be achieved at the joint/junction 306. In these embodiments, the pillar 300 of the core 30 can be formed by a pressure molding process immediately. Therefore, the manufacturing process of the pillar 300 of the core 30 is simpler than prior art and can be used to manufacture a small size core 30 adapted for the choke 3.

In this embodiment, Inequality 1, which is defined as follows, is satisfied:

$$0<d<\tfrac{1}{2}Y \qquad \text{Inequality 1}$$

wherein Y represents a length of the cross section along the second axis A2, d represents a difference of ½Y and ½ of the length t of the second substantially straight edge E3 (i.e., $d=\tfrac{1}{2}Y-\tfrac{1}{2}t$), and Y is larger than t. In the illustrated embodiment, d is the distance between a line extending from one of two upper first substantially straight edges E2 and a line parallel to the first axis A1 and passing the top point of the upper arc edge E1.

Preferably, Inequality 2, which is defined as follows, is satisfied:

$$\tfrac{1}{6}Y\leq d\leq\tfrac{1}{3}Y. \qquad \text{Inequality 2}$$

Furthermore, a ratio of a length t of the second substantially straight edge E3 and a length X of the cross section along the first axis A1 is between 0.5 and 0.7.

Moreover, a ratio of a thickness H1 of the first board 302 and a length L1 of the first board 302 is between 0.05 and 0.2, and/or a ratio of a thickness H2 of the second board 304 and a length L2 of the second board 304 is between 0.05 and 0.2.

Referring to FIGS. 3 and 5 again, the wire 32 of the choke 3 is wound around the pillar 300 and is located in the winding space S'. The wire 32 is formed by a copper wire coated with an enameled layer, and the enameled layer is an insulating layer. The wire 32 can be linear or spiral. Since the pillar 300 has an oval-like shape, when the wire 32 is wound around the pillar 300, the wire 32 can be closely attached to an outer wall of the pillar 300 to effectively wind the wire 32, and a relatively low direct current resistance (DCR) can also be obtained under an equivalent permeability effect.

A winding space S' is formed among the first board 302, the second board 304 and the pillar 300. In this embodiment, the magnetic material 34 is filled in the winding space S' and encapsulates the wire 32. The magnetic material 34 can be filled in the winding space S' by a transfer molding process, an injection molding process, or a coating process. The magnetic material 34 comprises a thermosetting resin and a magnetic powder. The thermosetting resin is an organic material not containing volatile solvent, and a viscosity of the thermosetting resin is between 12000 c.p.s. and 30000 c.p.s. before the thermosetting resin is heated. An average particle diameter of the magnetic powder is smaller than 20 μm. Preferably, an average particle diameter of the magnetic powder is between 4 μm and 10 μm. In this embodiment, the magnetic powder may comprise an iron powder (Fe) or a metallic powder (e.g. Fe—Ni, Fe—Cr—Si, Fe—Cr, Fe—Co—V, Fe—Ni—Mo, Fe—Si—A1, Fe—B, Fe—Co—B, Fe—Zr—B, Deltamax, Mu-metal, 4-79 Permalloy , Mo-Permalloy, Supermalloy, Sendust, Power Flux, etc.), wherein the content of the iron powder or metallic powder in the magnetic material 34 is between 50 wt % and 90 wt %, and, preferably, is between 60 wt % and 80 wt %, and the content of the thermosetting resin is less than 40 wt %. In this embodiment, the viscosity of the thermosetting resin is between 12000 c.p.s. and 18000 c.p.s. Preferably, a surface of the iron powder is coated with insulation.

In an embodiment, when the thermosetting resin and the iron powder are used to form the magnetic material 34, the thermosetting resin can bear a high temperature of more than 350° C. When a heating temperature exceeds a glass transition temperature, so as to satisfy a demand of a desolder temperature, the permeability of the magnetic material 34 can be easily controlled due to utilization of the iron powder. Moreover, since the viscosity of the thermosetting resin is between 12000 c.p.s. and 30000 c.p.s., the iron powder is easily mixed with the thermosetting resin to form the magnetic material 34, a tolerance range of a mixing ratio thereof is relatively high, and the thermosetting resin is easily coated in the winding space S'. Since the content of the thermosetting resin in the magnetic material 34 is less than 40 wt %, and the thermosetting resin does not contain any volatile solvent, during a heat-curing process, a thermal stress generated due to expansion and contraction of the thermosetting resin can be reduced, and the chance of forming blow holes are relatively small. Therefore, cracking of the core 30 can be avoided or significantly reduced. In addition, in this embodiment, the thermosetting resin is a polymer, for example, a polymethylallyl (PMA) synthesize resin, wherein a linear expansion coefficient of the thermosetting resin is between $1*10^{-5}$/° C. and $20*10^{-5}$/° C., and the glass transition temperature is between 130° C. and 170° C. Accordingly, when the magnetic material 34 is filled in the winding space S' by the aforesaid coating process, the permeability of the magnetic material 34 is between 4 and 12.

Particularly, in this embodiment, the glass transition temperature of the magnetic material 34 is substantially the same as the glass transition temperature of the thermosetting resin, and the linear expansion coefficient is about $13.8*10^{-5}$/° C., and the glass transition temperature is 150° C.

Furthermore, the magnetic material 34 may be filled in the winding space S' by the transfer molding process. In the transfer molding process, the thermosetting resin may be epoxy resin, phenolic resin, etc., and the magnetic powder material may be iron, Fe—Al—Si alloy, Fe—Cr—Si alloy, etc. When the magnetic material 34 is filled in the winding space S' by the transfer molding process, the permeability of the magnetic material is between 8 and 21.

Moreover, the magnetic material 34 may be filled in the winding space S' by the injection molding process. In the injection molding process, the thermosetting resin may be Polyamide 6 (PA6), Polyamide 12 (PA12), Polyphenylene Sulfide (PPS), Polybutylene terephthalate (PBT), ethylene-ethyl acrylate copolymer (EEA), and/or some other suitable resin material, and the magnetic powder material may be a metal soft magnetic material. The metal soft magnetic material may include iron, Fe—Al—Si alloy, Fe—Cr—Si alloy, stainless steel, and/or some other suitable material. When the magnetic material 34 is filled in the winding space S' by the injection molding process, the permeability of the magnetic material 34 is between 6 and 18.

In this embodiment, the permeability of the core 30 is between 25 and 60 and the permeability of the magnetic material 34 is between 4 and 21, so that the saturation characteristic of the choke 3 can be enhanced. As mentioned, the permeability of the magnetic material 34 is determined by the transfer molding process, the injection molding process, and/or the coating process. Table 1 shows the saturation characteristic of the choke 3 measured under different current values with related permeability of the core 30 and the magnetic material 34 according to the embodiments of the present invention and the prior art. The saturation characteristics in Table 1 are measured by the choke 3 with a size of 2 mm*1.6 mm*1.0 mm under a specific inductance value of 2.2 μH. It is clear that the saturation characteristic of the embodiments of the present invention is larger and better than the saturation characteristic of the prior art.

TABLE 1

| | Permeability of Core 30 | Permeability of Magnetic Material 34 | L@I_max 1.5A | 2A | 3A |
|---|---|---|---|---|---|
| Embodiments of the Present Invention | 25 | 21 | 86% | 80% | 70% |
| | 30 | 12 | 88% | 82% | 71% |
| | 35 | 9 | 87% | 81% | 69% |
| | 40 | 7 | 84% | 78% | 68% |
| | 50 | 6 | 83% | 77% | 66% |
| | 60 | 4 | 80% | 72% | 62% |
| Prior art | 400 | 4 | 73% | 64% | 48% |

It should be noted that since the magnetic material 34 of this embodiment does not contain any volatile solvent. After the magnetic material 34 is coated, it can be directly heat-cured without being rested in the room temperature for a span of time, and cracking and deforming of the core 30 can be avoided or significantly reduced when the magnetic material 34 is heat-cured. Therefore, compared to the conventional technique, the fabrication time of the choke 3 can be significantly shortened, and a pot-life of the magnetic material 34 will not be influenced by the formulation ratio. Therefore, the magnetic material 34 is suitable for mass production by the coating process.

As shown in the embodiment illustrated in FIG. 5, at least one corner of the second board 304 is exposed out of (i.e., outside of the area covered by) the first board 302 in a viewing angle from the first board 302 to the second board 304. In this embodiment, there are, but not limited to, four corners 3040, 3042 of the second board 304 exposed out of the first board 302 in the viewing angle from the first board 302 to the second board. In other words, the top/bottom surface of the first board 302 is smaller than the bottom/top surface of the second board 304. In this embodiment, a ratio of the top/bottom surface of the first board 302 to the bottom/top surface of the second board 304 is larger than 94% and smaller than 100%, and, preferably, between 95% and 98%, so as to keep good saturation characteristic. It should be noted that, in another embodiment, the top/bottom surface of the first board 302 may be larger than the bottom/top surface of the second board 304, and a ratio of the bottom/top surface of the second board 304 to the top/bottom surface of the first board 302 is still larger than 94% and smaller than 100%, and, preferably, between 95% and 98%, so as to keep good saturation characteristic. In other words, one of the first and second boards 302, 304 has a smaller top/bottom surface (smaller than 100% but larger than 94%, and, preferably, between 95% and 98%) than the bottom/top surface of the other one of the first and second boards 302, 304.

Figure 6:
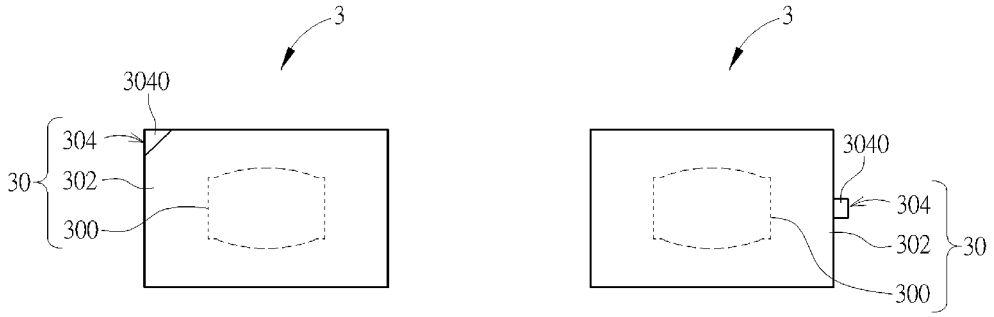
FIG. 6 is a top view of two different types of cores according to another embodiment of the present invention.

FIG. 6 is a top view of two different types of cores 30 according to another embodiment of the invention. As shown in FIG. 6, there is only one corner 3040 of the second board 304 exposed out of the first board 302 in the viewing angle from the first board 302 to the second board 304.

Figure 7:
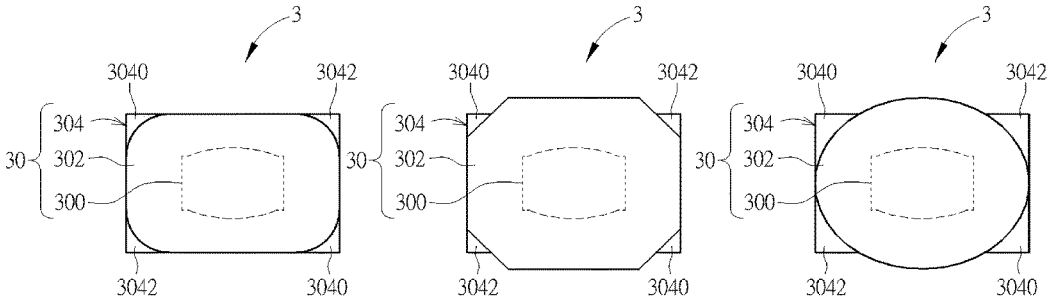
FIG. 7 is a top view of three different types of cores according to another embodiment of the present invention.

FIG. 7 is a top view of three different types of cores 30 according to another embodiment of the invention. As shown in FIG. 7, the shapes of the first and second boards 302, 304 may be changed, but the ratio of the top/bottom surface of the first board 302 and the top/bottom surface of the second board 304 still has to be larger than 94% and smaller than 100%, and, preferably, between 95% and 98%, so as to keep good saturation characteristic.

Accordingly, a plurality of cores 30 can be placed into a plurality of cavities of a mold at the same time and the second board 304 of each core 30 will be orientated toward the upside due to the exposed corners 3040, 3042, so that a pair of electrodes can be printed on the second board 304 of each core 30. Therefore, the core 30 with the exposed corners 3040, 3042 is suitable for mass production.

As embodied in the present invention, the cross section of the pillar of the core is substantially (i.e., within the range of manufacturing deviation) symmetrical with respect to both the long axis (e.g., the first axis A1) and the short axis (e.g., the second axis A2) thereof. In addition, compared to the conventional choke, since the cross section of the pillar of the core is non-circular and non-rectangular, such as oval-like, the area of the cross section of the pillar can be increased accordingly. Therefore, the saturation current of the choke can be raised effectively. Furthermore, since the cross section of the pillar has two arc edges opposite to each other, the wire can be wound around the pillar smoothly and the characteristics of the choke (e.g. saturation current, direct current resistance, magnetic flux density, etc.) are better than those of a conventional choke.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A choke comprising: a core structure having a first board, a second board, and a pillar located between the first and second boards, a winding space being located among the first board, the second board and the pillar, wherein the pillar has a non-circular and non-rectangular cross section along a direction substantially perpendicular to an axial direction of the pillar, wherein the periphery of the cross section of the pillar comprises a first substantially straight line, a first arc, a second substantially straight line, and a second arc on four sides of the periphery, respectively, wherein the substantially straight lines are interleaved with the arcs on the periphery of the cross section of the pillar, and wherein each arc is convex with respect to said substantially straight lines, wherein the distance between the middle point of the first arc and the middle point of the second arc is less than the distance between the middle point of the first substantially straight line and the middle point of the second substantially straight line, wherein a wire comprising a plurality of winding turns is disposed in the winding space, and each of said winding turns is wound around the first substantially straight line, the first arc, the second substantially straight line, and the second arc.

2. The choke of claim 1, wherein the first board, the second board, and the pillar are integrally formed.

3. The choke of claim 2, wherein the cross section of the pillar has a first axis and a second axis intersecting with each other at a center of the cross section of the pillar and being substantially perpendicular with each other, wherein a length of the cross section along the first axis is longer than or substantially equal to a length of the cross section along the second axis.

4. The choke of claim 3, wherein a ratio of a length of the second substantially straight line and the length of the cross section along the first axis is between 0.5 and 0.7.

5. The choke of claim 1, further comprising: a magnetic material filled in the winding space and encapsulating the wire, wherein the magnetic material comprises a resin and a magnetic powder, and an average particle diameter of the magnetic powder is smaller than 20 μm.

6. The choke of claim 1, wherein the extending length of each said arc is greater than that of each said substantially straight line, respectively.

7. The choke of claim 1, wherein the first arc is spaced apart from each of the first substantially straight line and the second substantially straight line.

8. The choke of claim 1, wherein the cross section of the pillar has a first axis and a second axis intersecting with each other at a center of the across section of the pillar, and the line connecting the middle point of the first arc and the middle point of the second arc passes through said center.

9. The choke of claim 1, wherein at least one corner of the second board is exposed out of the first board in a viewing angle from the first board to the second board.

10. A choke comprising:

a single-piece core having a first board, a second board, and a pillar located between the first and second boards, a winding space being located among the first board, the second board and the pillar, a permeability of the core being in a first range of 25 to 60;

a wire wound around the pillar and located in the winding space; and a magnetic material filled in the winding space and encapsulating the wire, a permeability of the magnetic material being in a second range of 4 to 21, wherein the permeability of the core and the permeability of the magnetic material are paired to increase a saturation current of the choke, wherein when a maximum current at 1.5 A is inputted to the choke, the saturation current of the choke is at least 80 percent of the maximum current at 1.5 A.

11. The choke of claim 10, wherein the permeability of the core being between 25 to 50 and the permeability of the magnetic material being between 6 to 21, wherein the saturation current of the choke is at least 83 percent of the maximum current at 1.5 A inputted to the choke.

12. The choke of claim 10, wherein the permeability of the core being between 25 to 40 and the permeability of the magnetic material being between 7 to 21, wherein the saturation current of the choke is at least 84 percent of the maximum current at 1.5 A inputted to the choke.

13. The choke of claim 10, wherein the permeability of the core being between 25 to 35 and the permeability of the magnetic material being between 9 to 21, wherein the saturation current of the choke is at least 86 percent of the maximum current at 1.5 A inputted to the choke.

14. The choke of claim 10, wherein the permeability of the core being between 30 to 35 and the permeability of the magnetic material being between 9 to 12, wherein the saturation current of the choke is at least 87 percent of the maximum current at 1.5 A inputted to the choke.

15. The choke of claim 10, wherein the magnetic material comprises a resin and a magnetic powder, and an average particle diameter of the magnetic powder is smaller than 20 μm.

16. The choke of claim 10, wherein the magnetic powder comprises a metallic powder, and the magnetic powder in the magnetic material is between 50 wt % and 90 wt %.

17. The choke of claim 10, wherein the magnetic powder comprises an iron powder, and the iron powder in the magnetic material is between 50 wt % and 90 wt %.

18. The choke of claim 10, wherein the magnetic powder comprises an iron powder, and the iron powder in the magnetic material is between 60 wt % and 80 wt %.

19. A choke comprising: a core structure having a first board, a second board, and a pillar located between the first and second boards, a winding space being located among the first board, the second board and the pillar, wherein the pillar has a non-circular and non-rectangular cross section along a direction substantially perpendicular to an axial direction of the pillar, wherein a circumference of the cross section of the pillar includes a first substantially straight edge, a first arc edge, a second substantially straight edge, and a second arc edge on four sides of the circumference, respectively, wherein the substantially straight edges are interleaved with the arc edges on the circumference of the cross section of the pillar, and wherein each arc edge is convex with respect to said substantially straight edges, wherein the cross section of the pillar has a first axis and a second axis intersecting with each other at a center of the cross section along the first axis is longer than or substantially equal to a length of the cross section along the second axis, wherein the second substantially straight edge is shorter than the length of the cross section along the second axis, and an inequality is satisfied:

$$0<d<\tfrac{1}{2}Y;$$

wherein Y represents the length of the cross section along the second axis, and d represents a difference of ½ Y and ½ of a length of the second substantially straight edge.

* * * * *